US007597037B2

(12) United States Patent
Beal

(10) Patent No.: US 7,597,037 B2
(45) Date of Patent: Oct. 6, 2009

(54) METHOD OF ENHANCING THE EXTERNAL BALLISTICS AND ENSURING CONSISTENT TERMINAL BALLISTICS OF AN AMMUNITION PROJECTILE AND PRODUCT OBTAINED

(76) Inventor: Harold F. Beal, 6277 Sierra Cir., Rockford, TN (US) 37853

( * ) Notice: Subject to any disclaimer, the term of this patent is extended or adjusted under 35 U.S.C. 154(b) by 103 days.

(21) Appl. No.: 11/612,718

(22) Filed: Dec. 19, 2006

(65) Prior Publication Data

US 2008/0141889 A1 Jun. 19, 2008

(51) Int. Cl.
*F42B 3/00* (2006.01)

(52) U.S. Cl. ..... 86/55; 86/53; 86/54

(58) Field of Classification Search ..... 86/53–54; 102/507–509

See application file for complete search history.

(56) References Cited

U.S. PATENT DOCUMENTS 3,311,962 A * 4/1967 Burns, Jr. ..... 86/55
4,793,037 A * 12/1988 Carter ..... 86/55
5,064,320 A * 11/1991 Markle ..... 408/202
5,131,123 A * 7/1992 Brooks ..... 86/54
5,259,320 A * 11/1993 Brooks ..... 102/509
5,471,719 A * 12/1995 Sawyers ..... 86/54
5,641,937 A * 6/1997 Carter ..... 102/507
5,943,749 A * 8/1999 Swank ..... 86/54
6,115,894 A * 9/2000 Huffman ..... 86/55
6,240,850 B1 * 6/2001 Holler ..... 102/439
6,371,029 B1 * 4/2002 Beal ..... 102/516
6,629,485 B2 * 10/2003 Vaughn et al. ..... 86/55
6,805,057 B2 * 10/2004 Carr et al. ..... 102/509
7,036,433 B2 * 5/2006 Beal ..... 102/519
7,162,942 B2 * 1/2007 Dippold ..... 86/55
2003/0140772 A1 * 7/2003 Vaughn et al. ..... 86/53
2004/0016357 A1 * 1/2004 Beal ..... 102/519

* cited by examiner

*Primary Examiner*—Michael Carone
*Assistant Examiner*—Daniel J Troy
(74) *Attorney, Agent, or Firm*—Pitts & Brittian, PC

(57) ABSTRACT

A method for geometrically enhancing of the flight of a projectile fired from a weapon to an intended target, including development of a flat annular face on the outermost end of the ogive portion of the projectile, such flat annular face being oriented in a plane that is substantially perpendicular to, and concentric with, the longitudinal centerline of the projectile, and further including extraction of extraneous material from the meplat cavity of the projectile while establishing at least a void volume within the meplat cavity which is substantially concentric with the longitudinal centerline of the projectile and of substantially uniform size and geometry from projectile to projectile. Geometric alteration of the wall thickness of the flat annular face also may be provided. An enhanced projectile and a round of ammunition are disclosed.

14 Claims, 8 Drawing Sheets

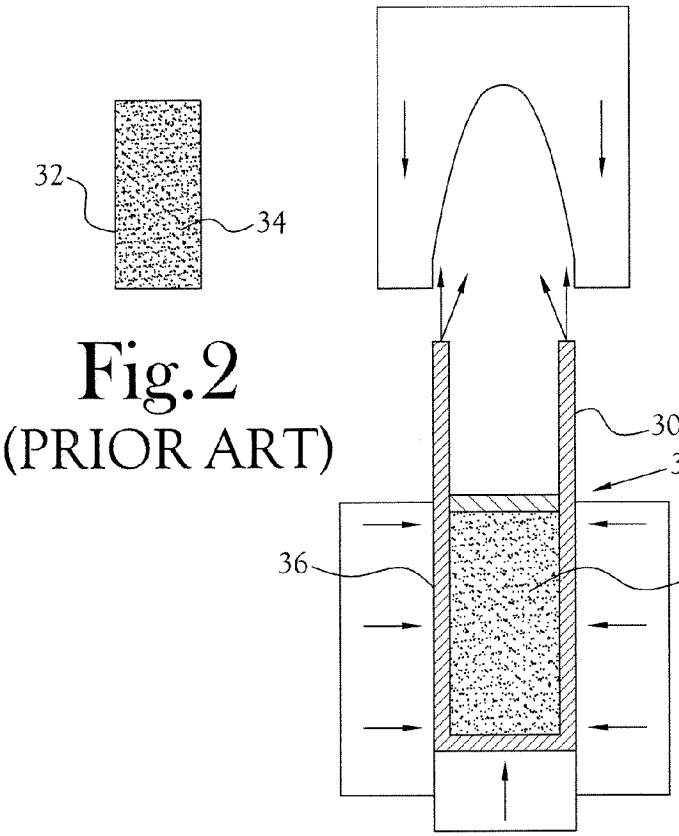
Fig.2
(PRIOR ART)
Fig.3
(PRIOR ART)
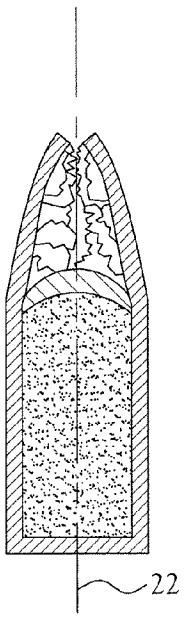
Fig.4
(PRIOR ART)
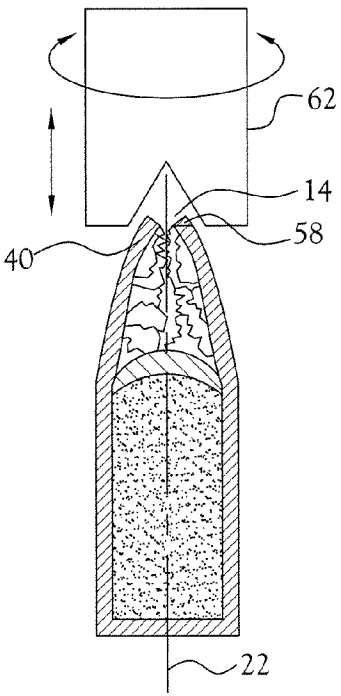
Fig.5
(PRIOR ART)

METHOD OF ENHANCING THE EXTERNAL BALLISTICS AND ENSURING CONSISTENT TERMINAL BALLISTICS OF AN AMMUNITION PROJECTILE AND PRODUCT OBTAINED

CROSS-REFERENCE TO RELATED APPLICATIONS

Not Applicable

STATEMENT REGARDING FEDERALLY SPONSORED RESEARCH OR DEVELOPMENT

Not Applicable

FIELD OF INVENTION

This invention relates to small arms ammunition, and particularly to the establishment of a substantially uniformly sized void volume and uniform geometry of the void volume of a meplat cavity and its associated meplat opening on the leading end of an ammunition projectile useful in the manufacture of small arms ammunition, such as ammunition for weapons of 50 caliber or smaller.

BACKGROUND OF THE INVENTION

A basic round of small arms ammunition, particularly rifle ammunition, commonly comprises a case having a primer disposed in a closed end thereof and adapted to receive a quantity of gun powder interiorly thereof. The case includes an open end adapted to receive therein a projectile (also commonly referred to as a "bullet"). Among other things, the depth to which the projectile is inserted into the case desirably produces an overall length of the case and projectile projecting therefrom which is consistently constant from round to round of ammunition of a given type, size, etc.

These projectiles commonly comprise a cup-shaped metal jacket (e.g. copper or brass) having a closed end and an open end. A core, usually of a metal, a compressed powdered metal, or a compressed mixture of two or more powdered metals, is inserted into the jacket. In one example, all of the core is fully contained within the jacket, leaving a portion of the jacket at its open end essentially void of core material. In this example, the open end of the jacket (and at times a portion of the core disposed within the jacket) are die-formed to define an ogive on the leading end of the jacket/core subassembly. In the course of forming the ogive, the open end of the jacket is not fully closed, thereby defining a meplat cavity and an associated meplat opening within the region of the ogive on the leading end of the projectile. In another example, the core is disposed within the jacket and the jacket is formed about the core thereby providing a projectile commonly referred to as a full metal jacket (FMJ) projectile. The present invention addresses the enhancement of the external ballistics and ensures consistent terminal ballistics of either of these types of projectiles.

More specifically, in certain situations, projectiles employed in weapons desirably impart massive destructive forces to an intended target. To this end, it has been heretofore common to provide an "open tip" in the leading end of a lead slug fired from a pistol or rifle. In many instances, the lead slug is covered, fully or partially with a metal jacket, such as copper, brass, or alloy material, and the "open tip" is defined in the leading end of the jacket so that when the leading end of the projectile strikes a target, such as the body of an animal, hydraulic pressure builds up in the open tip of the projectile, causing the projectile to "expand", "tear apart into multiple pieces" or otherwise create multiple relatively small units which individually destroy tissue, bones, etc. of an animal, for example.

Of the many ogived projectiles of the prior art, a majority of the projectiles include a meplat cavity defined in the leading end of the projectile and within the region of the ogive. This meplat cavity includes a meplat opening which leads from interiorly of the meplat cavity outwardly to the ambient environment. Functionally, the meplat cavity serves to enhance the expansion of the projectile upon it striking a target, hence enhancement of the terminal ballistics of the projectile. Such expansion occurs when the projectile strikes a target, such as an animal, and hydraulic pressure builds up within the meplat cavity, causing the ogive region of the projectile to commence deformation and/or disintegration of the projectile, such deformation and/or disintegration being propagated inwardly of the projectile along its length with resultant major deformation and/or disintegration of the projectile within the target. The performance of the projectile upon and following its striking of a target is referred to as "terminal ballistics" of the projectile. The performance of the projectile during its flight from the muzzle of the weapon to its impact with a target is referred to as the "external ballistics" of the projectile.

It has been proposed heretofore that the overall length of a projectile useful in the manufacture of small arms ammunition, be made uniform in an effort to enhance the flight of a projectile from a weapon barrel to a target. This prior practice is accomplished merely by trimming away excess metal jacket material from the leading end of the jacket after the projectile has been formed, employing a hand-operated trimming tool. This prior art technique effects a shortening of the overall length of the finished projectile. Coincidentally this prior art operation further tends to develop a flat annular face on the leading end of the projectile. The present inventors have found that this flat face of the projectile formed by the prior art techniques, is neither uniform in the thickness of the annular aspect of the face, nor is the plane occupied by the flat face necessarily perpendicular to, nor concentric with, the longitudinal centerline of the elongated projectile. More specifically, the metallic jackets commonly employed in the formation of a core-based projectile frequently exhibit differing wall thickness of the jackets. This variance in wall thickness may exist within a given lot of jackets as well as from lot to lot of jackets.

Moreover, in the process of forming an ogive on the leading end of a projectile, there occurs major displacement and/or movement (flow) of the metallic jacket material within the leading end of the jacket and in the region of the ogive. Such action most often results in non-uniform distribution of such displaced or moved jacket material and therefore non-uniformity of the wall thickness of the jacket within the region of the ogive. In the prior art practice of cutting away a portion of the leading end of a projectile to establish an overall length of the projectile and its case (i.e., a round of ammunition) the thickness of the jacket proximate the leading end of the jacket is increased or decreased as a function of the uniformity of the wall thickness of the jacket within the region of the ogive, i.e., within the region of the meplat cavity. This thickness of the leading end of the jacket may increase in a direction along the ogive and away from the leading end of the jacket, Thus, when employing the prior technique of flattening the leading edge of the jacket in order to gain the selected desired overall length of the projectile, more or less of the length of the jacket is cut away, resulting in undesirable variances in wall thickness of a given projectile and also from projectile to projectile at the annular flattened face of the leading end of projectile. Thus when the projectile is fired from a weapon, this annular flat face impacts the ambient air mass external and contiguous to the muzzle of the weapon at some uncertain orientation of the flat face relative to the flight path of the projectile. Moreover, the non-uniformity of the thickness of the annular aspect of the flat face of the projectile presents a non-consistent area of impact with the ambient air mass along the circumference of the annular face. Whereas the trimming of the leading end of the projectile to develop a consistent overall length of the projectile (and ultimately consistent uniformity of the overall length of the round of ammunition formed therefrom) reportedly serves to enhance the uniformity of flight of the projectile from the weapon barrel to the target as compared to a non-trimmed projectile, this prior art fails to fully address the uniformity of flight of the projectile and, importantly, also fails to address the issue of the terminal ballistics of the projectile when it strikes a target. Neither does this prior art address the ballistics coefficient of the projectile, all of which are of major concern when employing projectiles having a meplat opening and/or meplat cavity defined in the leading end of the projectile. Such meplat cavities and their associated outwardly facing opening are not only critical in establishing the accuracy of delivery of a projectile to an intended target, the present inventor has found that they also are critical for purposes of establishing the degree of penetration of the projectile into a given target, effecting expansion (frangibility) of the projectile when it strikes a target, and effecting the desired destruction of the target in addition to their effects upon the flight of the projectile to its intended target.

BRIEF SUMMARY OF THE INVENTION

In accordance with the present invention, an ammunition projectile having an ogive formed on the leading end thereof is geometrically enhanced, including the development of a flat annular face on the outermost end of the ogive portion of the projectile, such flat annular face being oriented in a plane that is substantially perpendicular to, and concentric with, the longitudinal centerline of the projectile, and further including extraction of extraneous material from the meplat cavity of the projectile while establishing a void volume of uniform size and geometry within the meplat cavity which is substantially concentric with the longitudinal centerline of the projectile and provision of meplat cavities which are of substantially uniform size and geometry from projectile to projectile. Geometric alteration of the wall thickness of the flat annular face also may be provided.

BRIEF DESCRIPTION OF DRAWINGS

FIG. 2 is a representation of one embodiment of a core suitable for use in the production of a projectile of the present invention;

FIG. 3 is a representation of the placement of a core as depicted in FIG. 2 into a metallic jacket, placement of the core/jacket combination into an ogive-forming die and depicting the pressure forces (arrows) imposed upon the core/jacket combination in the process of die-forming of an ogive on the leading end of the core/jacket combination;

FIG. 4 is a representation of a projectile whose ogive has been formed in a die as depicted in FIG. 3;

FIG. 5 depicts the action of tipping the leading end of the ogive of the projectile depicted in FIG. 4;

DETAILED DESCRIPTION OF THE INVENTION

Figure 1:
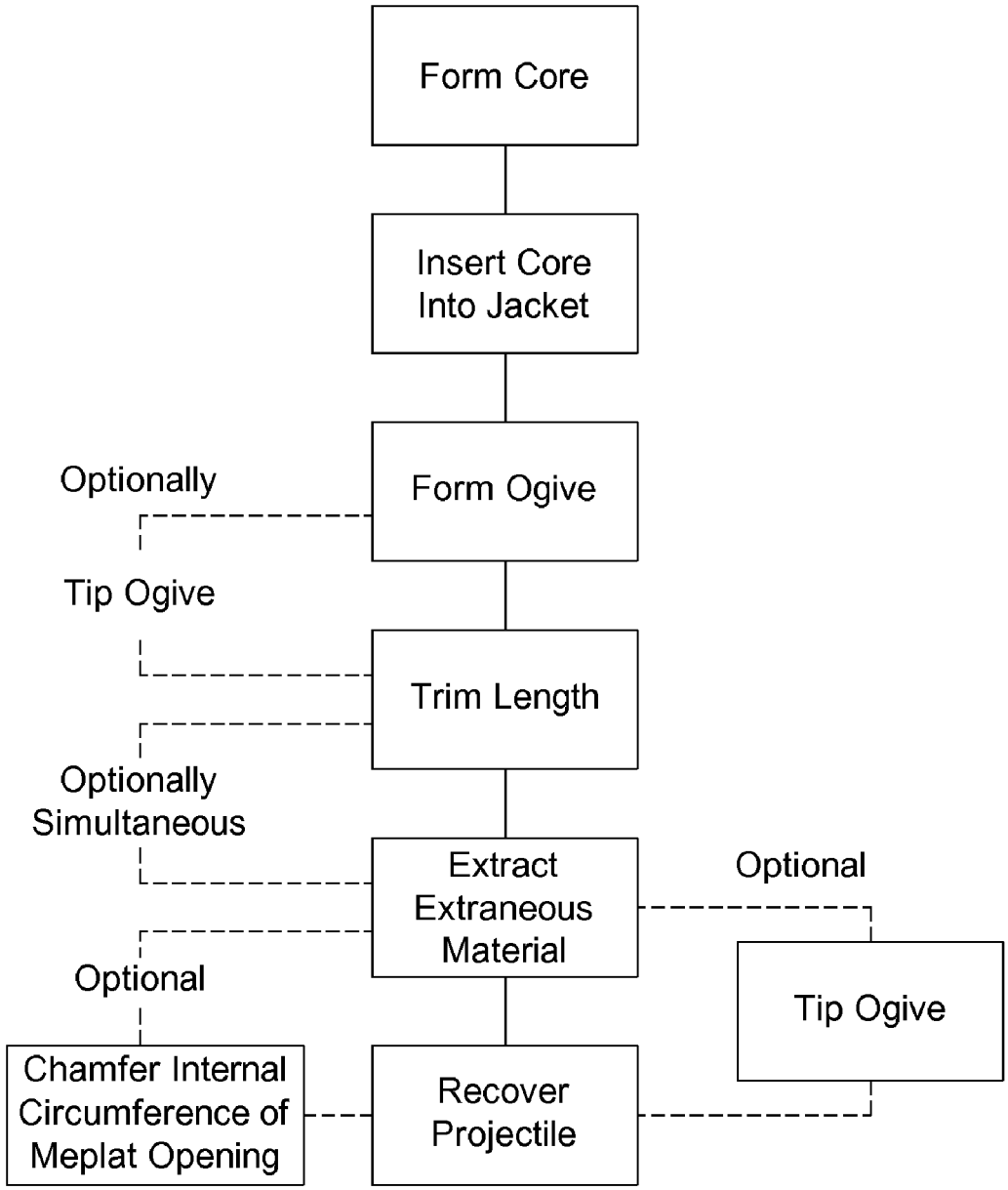
FIG. 1 is a schematic flow chart depicting the steps of one embodiment of the method of the present invention.

The present invention, in one aspect, (see FIG. 11), is directed to development of a meplat cavity 12 and its associated opening 14 following the formation of an ogive 16 on the leading end 18 of a projectile 20 with resultant establishment of uniformity from projectile to projectile of a plurality of projectiles of a given type, size, etc. (As used herein, "meplat" and "meplat cavity" are used synonymously unless the context of their use indicates otherwise).

Figure 6:
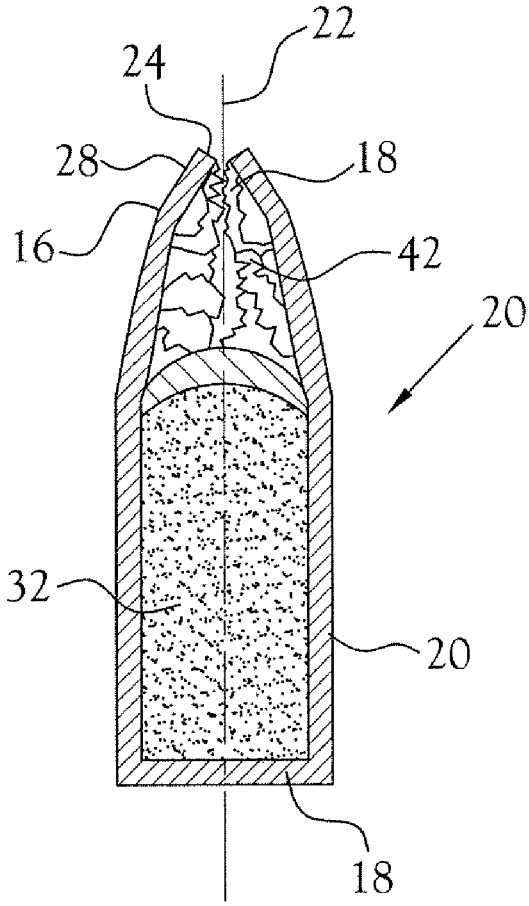
Fig.6 (PRIOR ART)
FIG. 6 is a representation of a projectile formed employing the actions depicted in FIGS. 3-5.

In the present invention such uniformity is obtained by establishing and maintaining a meplat cavity for the projectile which (from projectile to projectile) is of uniform void volume, of uniform size and geometry, and which is substantially concentric with the longitudinal centerline 22 of the projectile. Additionally, the opening of the meplat of the projectile is geometrically enhanced to effect consistent external ballistics of the projectile from projectile to projectile. In one aspect of the present invention, the geometrical enhancements of the meplat opening include establishing concentricity and perpendicularity of the flat annular face 24 of the meplat opening relative to the longitudinal centerline 22 (spin axis) of the projectile, and/or chamfering 26 of the internal circumference of the annular meplat opening, and/or tipping 28 (see FIG. 6) of the leading end 19 of the ogive 16 portion of the projectile, and/or selection of the wall thickness of the jacket 30 adjacent the meplat opening. By these actions, there is provided enhanced external ballistics and consistent attainment of the desired terminal ballistics.

Referring initially to FIGS. 1-5, in one embodiment, the method of the present invention comprises the steps of forming a core 32 for a projectile, commonly of a soft metal like lead, but preferably of a powdered metal 34 or a mixture of powdered metals. In the depicted embodiment, this core is encapsulated in an outer covering, such a cup-shaped metallic jacket 30. The core is seated within the jacket such that the core substantially conforms to the interior geometry of the cylindrical body portion 36 of the jacket terminating short of the open leading end of the jacket, thereby leaving a portion of the leading end of the jacket free of core material. The open leading end of the core/jacket subassembly 38 is thereafter die-formed (FIG. 3) to provide an ogive on such leading end, the resulting product commonly being referred to as a projectile 20. In the course of formation of the ogive on the projectile, there is defined a meplat cavity within, and opening outwardly of, the leading end of the projectile. Optionally, after forming the ogive, the outboard end 40 of the ogive may be topped to enhance the definition of the outboard end of the ogive.

Figure 7:
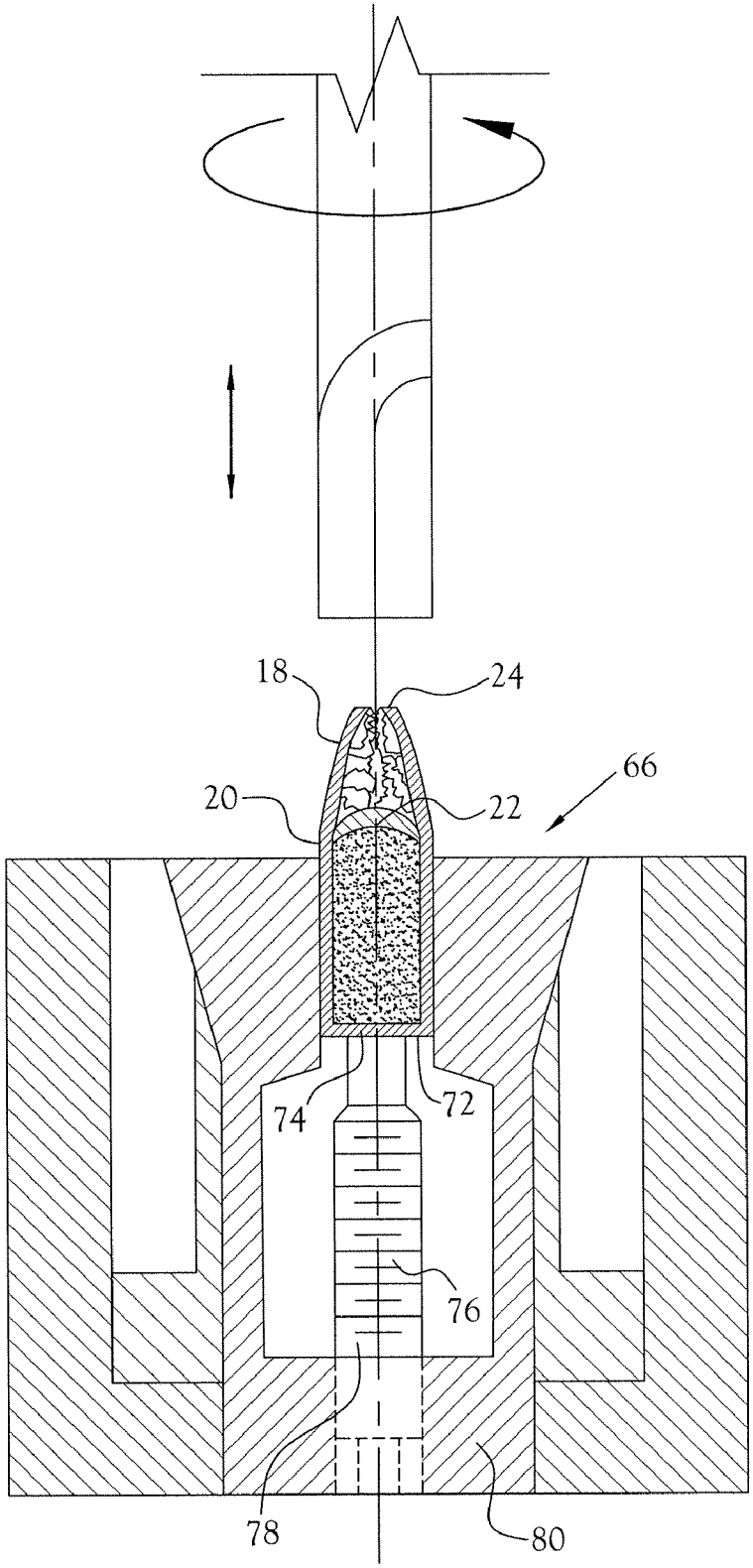
Fig.7 (PRIOR ART)
FIG. 7 is a representation of the step of trimming the leading end of a projectile as depicted in FIG. 6 by cutting away a portion of the ogive end of the projectile of FIG. 6 for adjusting the overall length of the projectile to a selected value.

A relatively recent practice has been to trim the projectile to a preselected overall length by cutting away a portion of the leading end of the ogive-bearing projectile, i.e., trimming the leading end of the projectile) (See FIG. 7).

The foregoing steps are generally well-known in the art so that the details thereof are deemed within the knowledge of one skilled in the art and do not require further elucidation herein.

Following the trimming of the projectile, in accordance with one aspect of the present invention, extraneous material 42 present within the meplat cavity as a result of the prior art techniques for the formation of a projectile, is extracted. This step further develops a standardized size and geometry of the meplat cavity and its outwardly opening end. Optionally, thereafter, the internal circumference of the meplat cavity opening may be chamfered and/or the outboard leading end of the projectile may again be tipped to adjust the geometry of the leading end of the projectile.

Figure 8C:
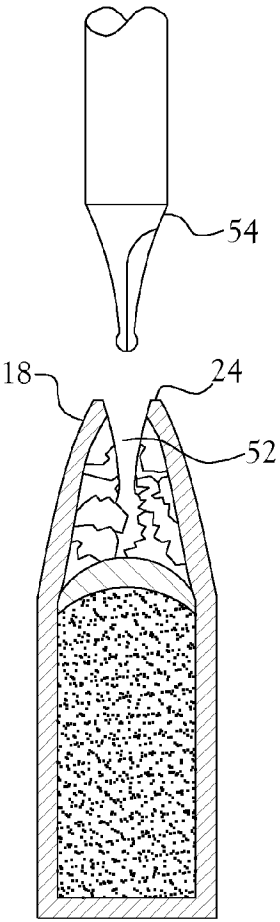
FIGS. 8A, 8B and 8C depict the removal of extraneous material and uniforming the meplat cavity and its outwardly opening end of a projectile which has been tipped as depicted in FIG. 6, employing one embodiment of the method of the present invention.
Figure 8B:
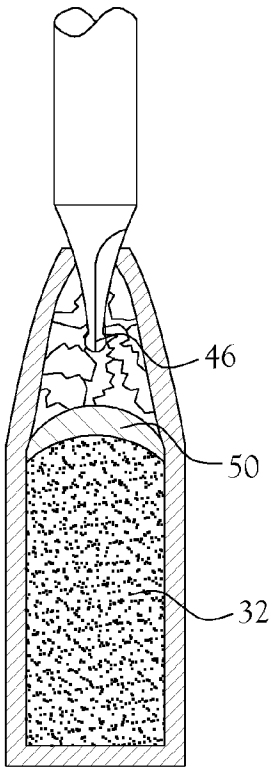
Figure 8A:
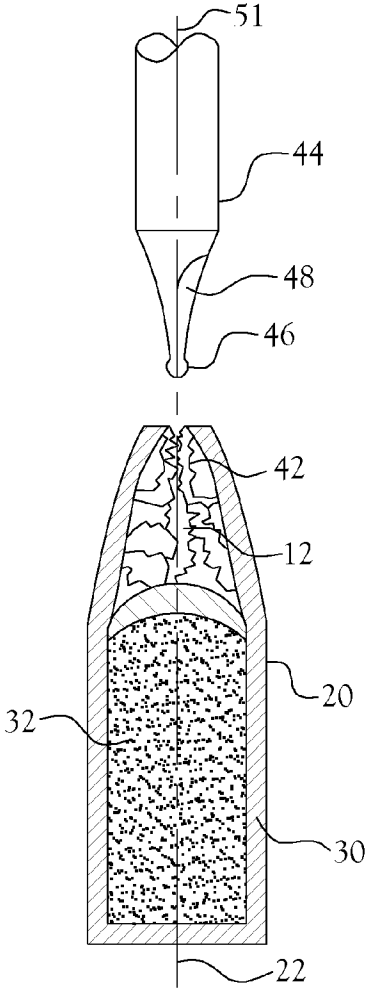

With reference to FIGS. 8A-8C, in one embodiment of the present method, extraneous material 42 disposed within the meplat cavity of a projectile is extracted employing an elongated rotating tool 44 having a ball-tipped distal cutting end 46 and cutting flutes 48 along the length of the cutting end of the tool, adapted to cut into the extraneous material in the meplat cavity and cut away and extract such extraneous material as the tool is urged into the clogged meplat cavity. This cutting action disintegrates the extraneous material into small individual elements which will readily pass out of the meplat cavity through the outwardly opening end of the meplat cavity, both as the cutting is taking place and/or the cutting tool is being withdrawn, and/or after the tool has been removed from the meplat cavity and the projectile is inverted to allow the cut away particles to fall out of the meplat cavity by gravity. As desired, or needed, a blast of pressurized air may be employed to aid in removal of the cut away particles from the meplat cavity. It will be recognized by one skilled in the art that the projectile is held stationary in a preselected position relative to the cutting tool, as by either securing the projectile in a die or in a collet 66 of the type depicted in FIG. 7.

A typical collet is depicted in FIG. 7. In the depicted collet for positioning of the projectile for enhancement thereof, the closed end 72 of the projectile rests on the inboard end 74 of a vertically oriented threaded post 76 whose outboard end 78 is threadably received within the body 80 of the collet. The vertical position of the inboard end of the post, hence the closed end of the projectile, is selectable by rotating the threaded post within the body of the collet. In the embodiment depicted in FIG. 7, the leading end of the projectile is exposed externally of the collet and thereby made readily accessible for work to be performed thereon.

As noted, the longitudinal centerline 22 of the projectile and the longitudinal centerline 51 of the cutting tool 44 are aligned concentrically. The tool of the depicted embodiment of the present invention includes a ball-tipped cutting distal end 46 and double-fluted side cutting edges 48. Once the projectile and its collet are aligned in vertical registration with the centerline of the cutting tool, the tool is activated (commenced to rotate about its longitudinal centerline) and lowered toward the leading end of the projectile so that the distal cutting ball tipped portion of the tool enters the meplat at a location concentric with the longitudinal centerline of the projectile held in the collet. As the tool is lowered to the extent required to cause the cutting surfaces of the tool to engage and cut away the extraneous material disposed with the meplat cavity, defining a meplat cavity of a preselected size, geometry and orientation on the leading end of the projectile. Simultaneously, this cutting action of the tool defines a preselected inner diameter 56 of the outwardly opening end of the meplat cavity. By reason of the alignment of the projectile within the collet being concentric with the longitudinal centerline of the cutting tool, the longitudinal centerline of the evacuated meplat cavity and its outwardly open end are formed concentrically with the longitudinal centerline (i.e./. the spin axis) of the projectile.

It will be recognized that the diameter of the meplat opening and the general diameter of the void volume in the meplat cavity may be chosen and developed by selecting a given diametral size for the cutting portions of the tool, including sloping side flutes as desired. In similar manner, the depth of the insertion of the cutting portions of the tool into the clogged meplat cavity is selectable by selecting the extent of vertical movement of the tool as it is inserted into the meplat cavity.

Figure 10:
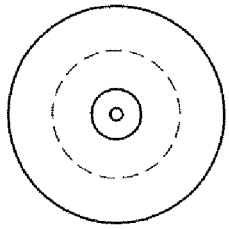
FIG. 10 is a top view of the projectile depicted in FIG. 8C after extraction of extraneous material from the meplat cavity of the projectile and uniforming of the meplat cavity size and geometry and its opening.

Further, through selection of the geometry of the cutting portions of the tool, and selection of the depth of penetration of the cutting tool into the projectile, one can cut away more or less of the thickness of the annular wall of the leading end of the projectile, hence alter the wall thickness of the flat annular face 24 defined on the leading end of the projectile. This wall thickness can be varied from a razor sharp edge to a wall thickness substantially equal to the original wall thickness of the jacket in the area of its leading end. A given wall thickness is selected as a function of the desired characteristics of the air flow past the projectile during its flight to a target, and/or the desired resistance, or absence of resistance, offered by the meplat cavity to expansion and/or disintegration of the projectile upon it striking an intended target. One embodiment of a completed geometrically modified leading end of a projectile is depicted in FIG. 10 wherein there may be observed the modified meplat cavity void volume, the modified inner diameter of the meplat opening, the definition of a flat annular face on the leading end of the projectile, and the wall thickness of the jacket in the area adjacent the leading end of the projectile.

As noted hereinabove and as depicted in FIG. 8B, the cutting tip of the tool 44 is urged into the meplat cavity to a limit. Such limit is established as being short of engagement of the distal tip 46 of the tool 44 with the core or any cap 50 disposed within the jacket. This limit is set to be the same for each projectile so that the depth of entry of the cutting tip of the tool into the projectile is the same from projectile to projectile.

As depicted in FIG. 8C, the cutting action of the tool develops a void volume 52 of the meplat cavity in the leading end 18 of the projectile which, from projectile to projectile, is uniform both in size and geometry. In the embodiment depicted in FIGS. 8A-8C, the cutting action does not alter the perpendicularity of the flat annular face 24 of the leading end of the projectile which is developed in the course of trimming of the ogive end of the projectile. The taper on the cutting tip, however, functions also to open the inner circumferential diameter of the meplat cavity opening to a constant value from projectile to projectile.

Further alteration of the meplat cavity opening 14 may be effected in the present method by subjecting the projectile depicted in FIG. 8C to a tipping operation as depicted in FIG. 5, wherein the outer circumferential rim 58 of the meplat cavity opening is drawn inwardly toward the longitudinal centerline 22 of the projectile, thereby reducing the outer and/or inner diameter of the meplat cavity opening. By this means, it is possible to selectively provide a given desired inner diameter for the meplat cavity opening for purposes of enhancing the effectiveness of the meplat cavity in the expansion and disintegration of the projectile upon the projectile striking an intended target. For example, in either pistol or rifle projectiles, the inner diameter of the meplat cavity opening may be adjusted to limit the degree of penetration of the projectile into an animal, for example, whereupon disintegration of the projectile is either commenced and/or completed. In many instances, this enhancement of the timing of disintegration of the projectile may be such as to permit a small opening (not greater than the size of the outer diameter of the projectile) upon entry of the projectile into the target and further, to provide for essentially complete disintegration of the projectile fully within the body of the animal target, for example. Such precise control over the disintegration of the projectile upon striking an intended target is not known to exist in the prior art.

On the other hand, when greater or full penetration of an intended target is desired, or full penetration of an obstacle between the target and the advancing projectile, such as a vehicle windshield, is desired, the present invention provides for adjustment (reduction normally) of the inner diameter of the meplat cavity opening to the extent that the projectile will fully penetrate the obstacle without disintegrating and continue its flight to a target beyond the obstacle and thereupon disintegrate within the intended target.

Figure 9:
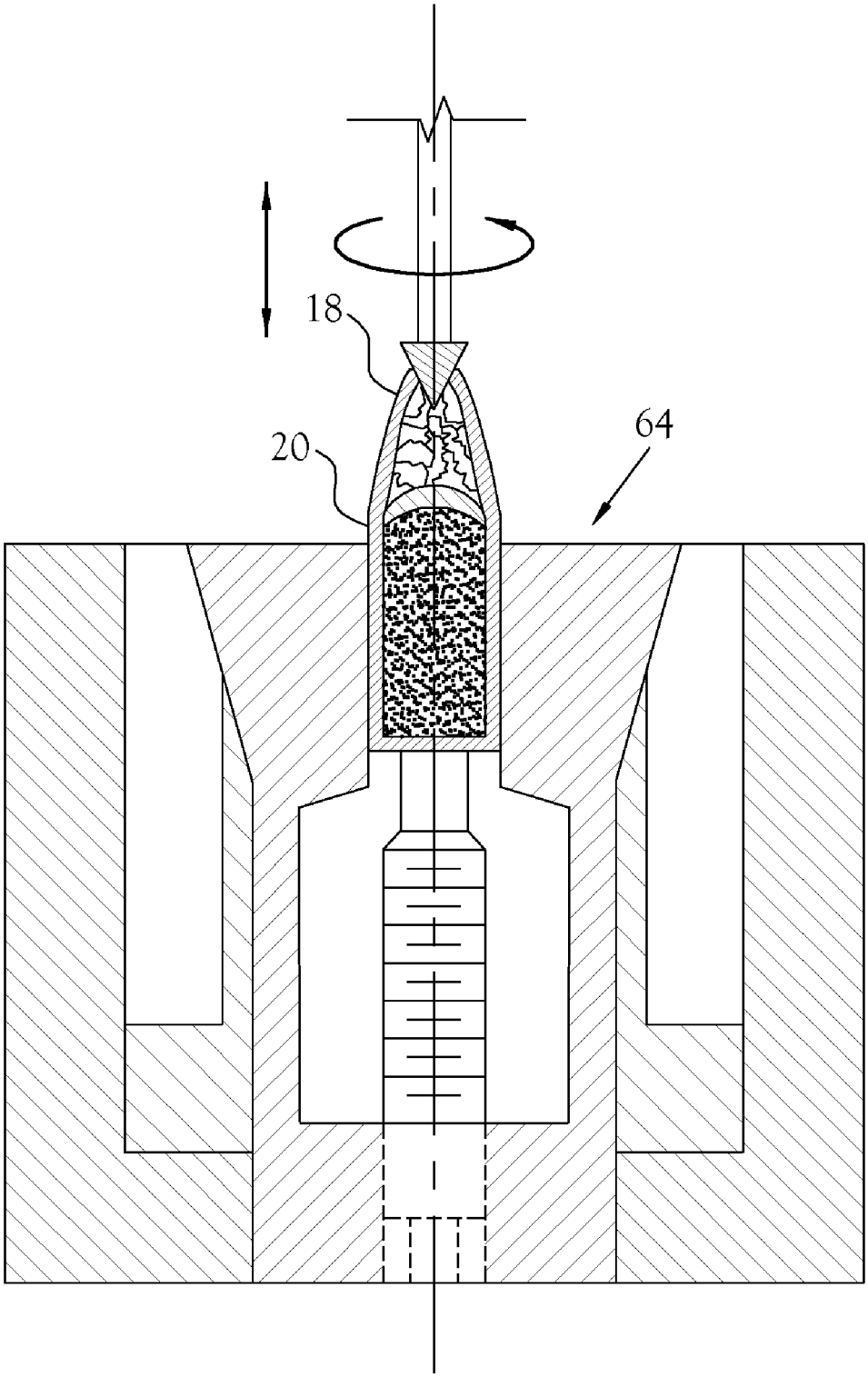
FIG. 9 depicts one embodiment of apparatus for burnishing the inner rim of the meplat opening of the projectile depicted in FIG. 80.

Referring to FIG. 9, as an adjunct to the tipping of a projectile having a uniform meplat cavity and cavity opening as provided by the present invention, such projectile may be subjected to a burnishing of the inner rim 56 of the meplat cavity opening employing a conical burnishing tool 64 known in the machining art. This burnishing action serves to smooth off any rough edges, slivers, etc. which may be present on the inner rim of the meplat opening, thereby enhancing the consistency of flight of the projectile to its intended target by eliminating potential eddies of air flow as the projectile moves through the air to the target. Further, the provision of a smooth surface along the inner rim of the meplat cavity enhances the entry into the meplat cavity of that fluid which develops a hydraulic pressure within the meplat cavity for commencing and continuing disintegration of the projectile upon the projectile striking an intended target. Following the establishment of a flat annular face 24 on the leading end of the projectile and extraction of extraneous material from the meplat cavity of the projectile, optionally the projectile may be subjected to a further tipping operation as depicted in FIG. 5 wherein the tipping-type die punch 62 is forced into engagement with the extreme outboard portion of the leading end of the ogive portion of the projectile. This function may be performed with the punch rotating and brought into relatively slight physical engagement with the extreme outboard portion of the leading end of the projectile. This action tends to eliminate any burrs or discontinuities along the outer circumference of the leading end of the projectile, thereby further enhancing the resistance of the projectile to deviation from its intended flight path to an intended target. As desired, alternatively, the tipping tool may be maintained fixed and the projectile rotated.

In one example, projectiles for a 300 Win Mag rifle were formed employing cores which were formed from a mixture of powdered metals by pressing respective quantities of the mixture in a die at room temperature. Each core was inserted through the open end of a cup-shaped brass jacket of the type commonly used in the manufacture of 300 Win Mag projectiles and seated within the jacket. A tin disc of about 0.030 inch thickness was placed on the outboard end of the core and the core/jacket subassembly (including the disc, in this example) was placed in a known ogive-forming die and punch combination. The punch was urged into the die to form the desired ogive on the leading end of the projectile. Thereafter the leading end of the projectile was tipped employing a conventional tipping punch. These actions defined both the ogive on the end of the projectile and a meplat cavity within the leading end of the projectile, such meplat cavity having an outwardly opening end. In this example, the projectile as so formed exhibited a meplat opening having an inner diameter of less than 0.040 inch. The outer diameter of the leading end of the jacket at the meplat opening was 0.060 inch. Visual inspection of the projectile so produced revealed massive extraneous jacket material lodged at random locations within the intended meplat cavity. Moreover, that portion of the meplat cavity which was free of extraneous material was commonly out of alignment with the longitudinal centerline of the projectile, thereby subjecting the projectile to possible mutation when the projectile was fired toward an intended target.

Each projectile of this example was trimmed to a preselected overall length, e.g., about 1.300 inches, providing a flat annular face on the projectile. This flat annular face was disposed substantially concentrically of the longitudinal centerline of the projectile and was oriented in a plane which was substantially perpendicular to the longitudinal centerline of the projectile. Each trimmed projectile was tipped to develop an outer circumferential diameter of the meplat opening of about 0.050 inch.

Thereafter, each projectile was secured with its longitudinal centerline concentric align with a conically shaped, distally ball-tipped, cutting tool having a ball diameter of 0.045 inch and side cutting flutes. As the cutting tool was rotated about its longitudinal centerline, its cutting tip was urged into the clogged meplat cavity of the projectile to a depth of 0.0150 inch whereupon the extraneous material within the intended meplat cavity was cut away to define within the meplat cavity a void space which was basically of the same geometry as that portion of the cutting tool which entered the meplat cavity. In the present example, the inner circumferential diameter of the excavated meplat cavity was 0.045 inch over substantially its entire depth. The thickness of the annular flat face of the leading end of the jacket, after excavation of the meplat cavity was 0.040 inch.

Optionally, following excavation of the meplat cavity, the leading end of the jacket was again tipped. In this embodiment, the tipping reduced the outer diameter of the leading end of the jacket to about 0.045 inch, and, the internal diameter of the meplat cavity opening so that the width of the flat face on the leading end of the jacket was reduced to about 0.250 inch. In a further embodiment, the leading end of the jacket having an outer diameter of 0.060 inch was drilled with a 0.060 diameter ball tipped end mill so that the wall thickness of the jacket (hence the wall thickness of the open end of the meplat cavity) was reduced to a razor sharp edge, (e.g. about 0.001 inch). By means of further tipping, this razor sharp edge was reduced sufficiently to develop an internal diameter of the meplat cavity of between 0.045 and 0.010 inch, as desired.

Figure 13:
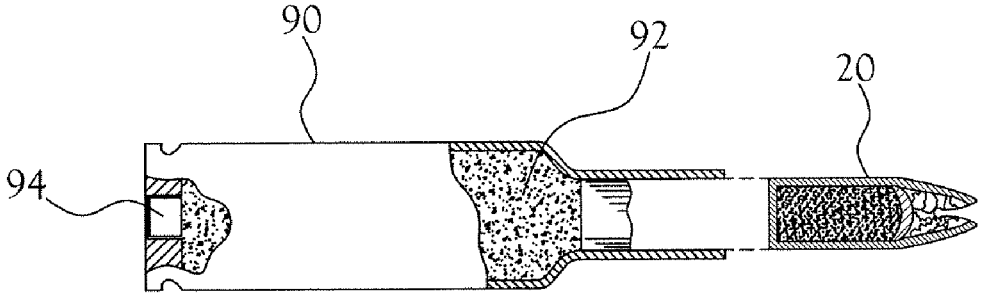
FIG. 13 is a diagrammatic representation of a projectile of the present invention as depicted in FIG. 11 poised to be incorporated into a convention case for a round of ammunition, and, FIG. 14 is a diagrammatic representation of a projectile as depicted in FIG. 11, incorporated into a round of ammunition.
Figure 14:
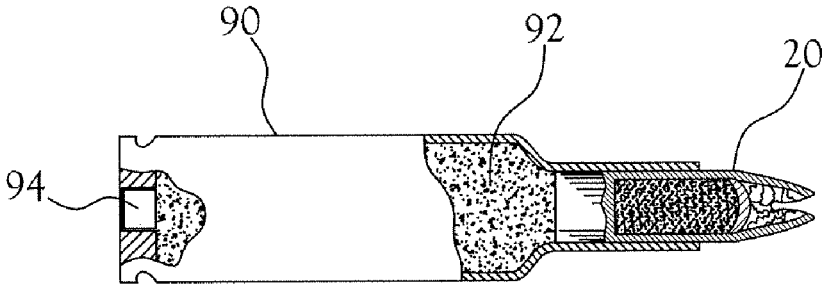
Figure 12:
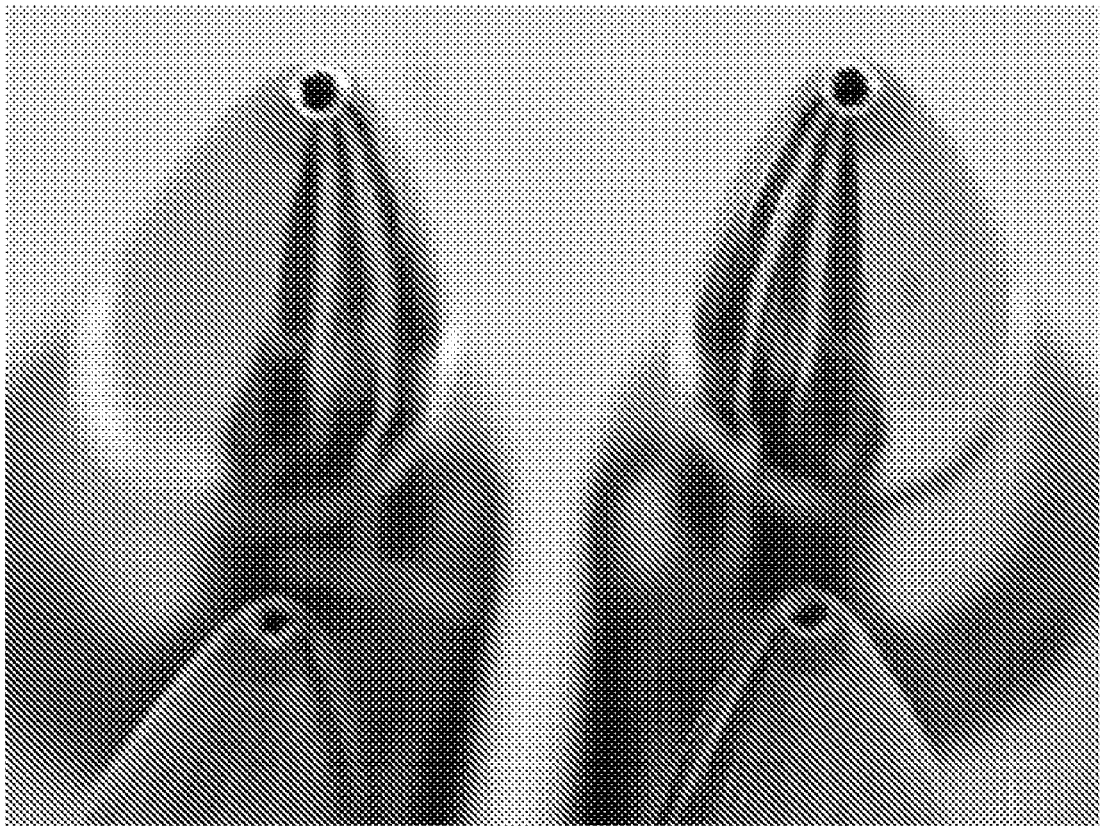
FIG. 12 is a generally top view of multiple projectiles which have been formed employing the method of the present invention and thereafter incorporated into a round of ammunition.

Projectiles produced in accordance with the present invention were incorporated into conventional outer cases containing gun powder and a primer to define a round of ammunition as is conventional known in the art FIG. 13 depicts a projectile 20 produced in accordance with the present invention poised for incorporation into a conventional case 90 containing gun powder 92 and a primer 94. FIG. 14 depicts a round of ammunition 96 as formed by the incorporation of a projectile 20 of the present invention into a case 90 of the nature of the case depicted in FIG. 13.

Figure 11:
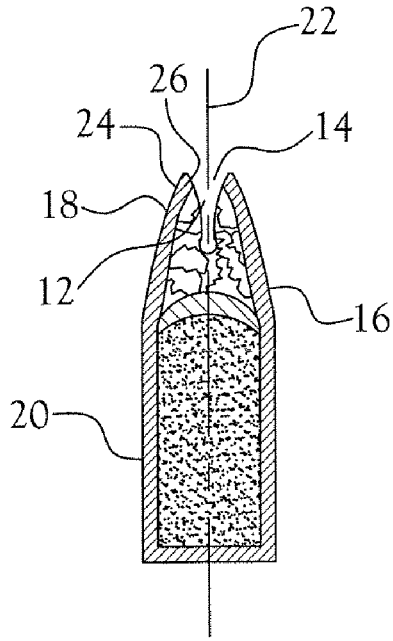
FIG. 11 is a representation in section, of a projectile formed employing the method of the present invention.

FIG. 11 is a photographic representation of a plurality of the completed projectiles of the above example. Notably, the depicted meplat openings of the projectiles are uniform and of substantially the same size and geometry from projectile to projectile. When fired from a 300 Win Mag rifle, the projectiles of the above example exhibited enhanced accuracy of delivery to an intended target 600 yards distant from the firing stand. More particularly these projectiles consistently produced 5-shot groups having a maximum spread of less than one minute of angle (MOA) inches or less with no errant flights (known as "flyers" in the art).

Whereas various of the individual steps or actions depicted in the Figures are known in the art, the present inventor has discovered that these steps or actions, as practiced in the prior art, generate extraneous material within the meplat cavity, and that such extraneous material deleteriously affects the performance of a projectile by reason of the non-uniformity of the geometry of the meplat cavity, non-concentricity of the meplat cavity and/or meplat opening relative to the longitudinal centerline of the projectile, and of the non-uniformity of perpendicularity of the flat annular face on the leading end of a trimmed projectile to the longitudinal centerline of the projectile.

In accordance with one aspect of the method of the present invention, a projectile, having an ogive formed on the leading end thereof and a meplat cavity and associated outward opening, as referred to hereinabove, is releasably and rigidly mounted in a collet 66 of the type depicted in FIG. 7, to present the leading end 18 of the projectile for geometrical enhancement of the leading end of the projectile. By design, the projectile, when releasably secured within the collet, is aligned with its longitudinal centerline concentric with the longitudinal centerline of a cutting tool and with the flat annular face of the projectile oriented perpendicular to the longitudinal centerline of the tool.

Through the means of the herein described geometrical modification of the leading end of a projectile, the present inventor has found that when the flat annular face of multiple projectiles of the same caliber, when fired from a weapon, all exhibit essentially the same impact forces when the projectile leaves the muzzle of a rifle or pistol, thereby providing uniformity of muzzle velocity from projectile to projectile. Moreover, the uniformity of wall thickness, the degree of perpendicularity of the flat annular face to the longitudinal centerline of the projectile, and concentricity of the meplat opening (and the newly modified meplat cavity) from projectile to projectile provides enhanced accuracy and uniformity of delivery of the projectiles to their intended targets. Further, these and other factors, such as the overall length of the projectile, hence the overall length of a round of ammunition containing the projectile, enhances the feeding of the uniformed projectiles from a magazine into the breech of a weapon. Uniformity of overall length of the projectiles further serves to ensure uniform spin stability of the projectiles while in flight to a target. Again, uniformity of wall thickness of multiple projectiles of the same caliber, ensures uniformity of the desired expansion and/or disintegration of the projectile at the desired location on or within an intended target.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

By way of example, it will be recognized that projectiles of the full metal jacket type wherein the entire leading end of the projectile is closed in the course of formation of the ogive, employing the method of the present invention, one may cut through the leading end of the metal jacket and further cut away extraneous material from the leading end of the projectile to define a void volume of a meplat cavity.

Further, as desired, the geometry of the tool employed in the extraction of the extraneous material and defining of the void volume of the meplat cavity may be chosen to define any of many sizes and/or geometries of the void volume of the meplat cavity. In all instances, it is of critical importance that the definition of the void volume of the meplat cavity be established and maintained from projectile to projectile of a given caliber and type of round of ammunition, and that the concentric orientation of the void volume (meplat cavity) relative to the longitudinal centerline of the projectile be consistent from projectile to projectile.

Still further, as desired, one may employ the method of the present invention to define a meplat cavity of uniform size and geometry in the leading end of a solid metal projectile (no jacket).

What is claimed:

1. A method for enhancing the delivery of a projectile from a weapon to an intended target comprising the steps of Providing a projectile suitable for firing from the weapon, said projectile including an open leading end and a trailing end, an ogive defined on said leading end, and a longitudinal axis extending between said leading and trailing ends, said leading end including a meplat cavity extending toward the interior of said projectile substantially concentric with said longitudinal axis for a preselected distance from said leading end, said meplat containing a quantity of non-uniformly distributed extraneous jacket material disposed therein, reducing the overall length of said projectile from its leading end to its trailing end to a preselected value which is optimal for developing a completed round of ammunition embodying the projectile, said value being constant from projectile to projectile, and defining a substantially annular planar outermost face on said leading end of said projectile, said annular planar outermost face being disposed in a plane which is substantially perpendicular to said longitudinal axis of said projectile, thereafter, while said projectile is maintained in a stationary attitude, substantially simultaneously cutting away and removing extraneous material disposed within said meplat cavity from said projectile to define an excavated meplat cavity having a void volume of a predetermined depth and inner circumferential geometry, said excavated meplat cavity having a longitudinal centerline which is substantially concentric with the longitudinal centerline of the projectile.

2. The method of claim 1 wherein said projectile includes an outer circumferential rim on said leading end of the said projectile, and including the further step of reducing the circumference of said outer circumferential rim with minimal concomitant reduction in the void volume or geometry of said excavated meplat cavity.

3. The method of claim 1 wherein said projectile comprises a core disposed within a cup-shaped metallic jacket having an open end, and including the step of reducing the overall length of said projectile by removal of a portion of said jacket at its open end.

4. The method of claim 1 wherein said projectile is formed from a particulate material.

5. The method of claim 1 and including the further step of, following said formation of said annular outermost planar face of said projectile, of burnishing said annular outermost planar face of said projectile at about at least one of the outer or inner rim of said most annular outermost planar face of said projectile.

6. The method of claim 1 and including the step of incorporating said projectile into a round of ammunition.

7. The method of claim 4 wherein said particulate material comprises at least one metal powder.

8. A projectile formed in accordance with the method of claim 1.

9. The projectile of claim 8 wherein said void volume in said meplat cavity is essentially constant in size and geometry from projectile to projectile.

10. The projectile of claim 1 wherein said projectile is frangible when striking a target.

11. A round of ammunition for a weapon comprising a projectile manufactured in accordance with the method of claim 1.

12. The method of claim 1 including the steps of;

Geometrically deforming said leading end of said projectile to define an annular planar outermost face on said leading end, said face being oriented substantially perpendicular to and substantially concentric with, said longitudinal centerline of said projectile, and, Extracting extraneous jacket material from said meplat cavity.

13. The method of claim 12 and including the step of further deforming said leading end of said projectile following said defining of said annular planar outermost face and extraction of extraneous jacket material from said meplat cavity.

14. The method of claim 12 wherein said step of extracting said extraneous jacket material from said meplat cavity comprises substantially simultaneously cutting away extraneous material disposed within said meplat cavity and defining a preselected void volume which, from projectile to projectile, is of uniform size and geometry and substantially free of extraneous material.

* * * * *